US007326081B2

(12) United States Patent
Singer

(10) Patent No.: US 7,326,081 B2
(45) Date of Patent: Feb. 5, 2008

(54) PLUG-AND SOCKET CONNECTOR

(75) Inventor: Helmut Singer, Bad Ditzenback (DE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 11/728,489

(22) Filed: Mar. 26, 2007

(65) Prior Publication Data

US 2007/0232117 A1 Oct. 4, 2007

(30) Foreign Application Priority Data

Apr. 4, 2006 (DE) ..... 10 2006 016 882

(51) Int. Cl.
*H01R 13/40* (2006.01)

(52) U.S. Cl. ..... 439/595

(58) Field of Classification Search ..... 439/595, 439/752, 596, 603

See application file for complete search history.

(56) References Cited

U.S. PATENT DOCUMENTS 5,122,080 A * 6/1992 Hatagishi et al. ..... 439/595
5,273,456 A * 12/1993 Muzslay ..... 439/489
6,554,645 B1 * 4/2003 Boemmel et al. ..... 439/595

FOREIGN PATENT DOCUMENTS

DE 42 05 974 C 1 6/1993
EP 1 176 670 A 1 1/2002

* cited by examiner

*Primary Examiner*—Phuong Dinh
(74) *Attorney, Agent, or Firm*—Peter Van Winkle

(57) ABSTRACT

A plug-and-socket connector (10) has a plastic housing (11) that holds electrical male or female contacts (14) in boreholes (16, 17) next to each other, and whose forward end forms a plug extension (13) or as a socket extension (113) and whose rear end receives and locks the male or female contacts (14) in the housing (11). In a plug and socket connector (10) of this type, in order to lock the male or female contacts in two ways, independently of each other, in the plastic housing (11), at the same time permitting the plastic housing (11) to be shaped using injection molding technology in a relatively simple manner, it is provided that, for receiving a male or female contact (14), a first catch (37) protrudes in the area of each borehole (16, 17) located on the other, rear housing end (12, 112), the catch being arranged on a fixed wall (36) of the rear housing end and engaging a first collar (29) of the male or female contact (14) from behind, and a second catch (41, 51) is provided on a cover (23, 24) so as to allow the radially open rear housing end (12) to be closed and covered, the catch engaging the first collar (29) or a second collar (30) of the male or female contact (14) from behind.

18 Claims, 4 Drawing Sheets

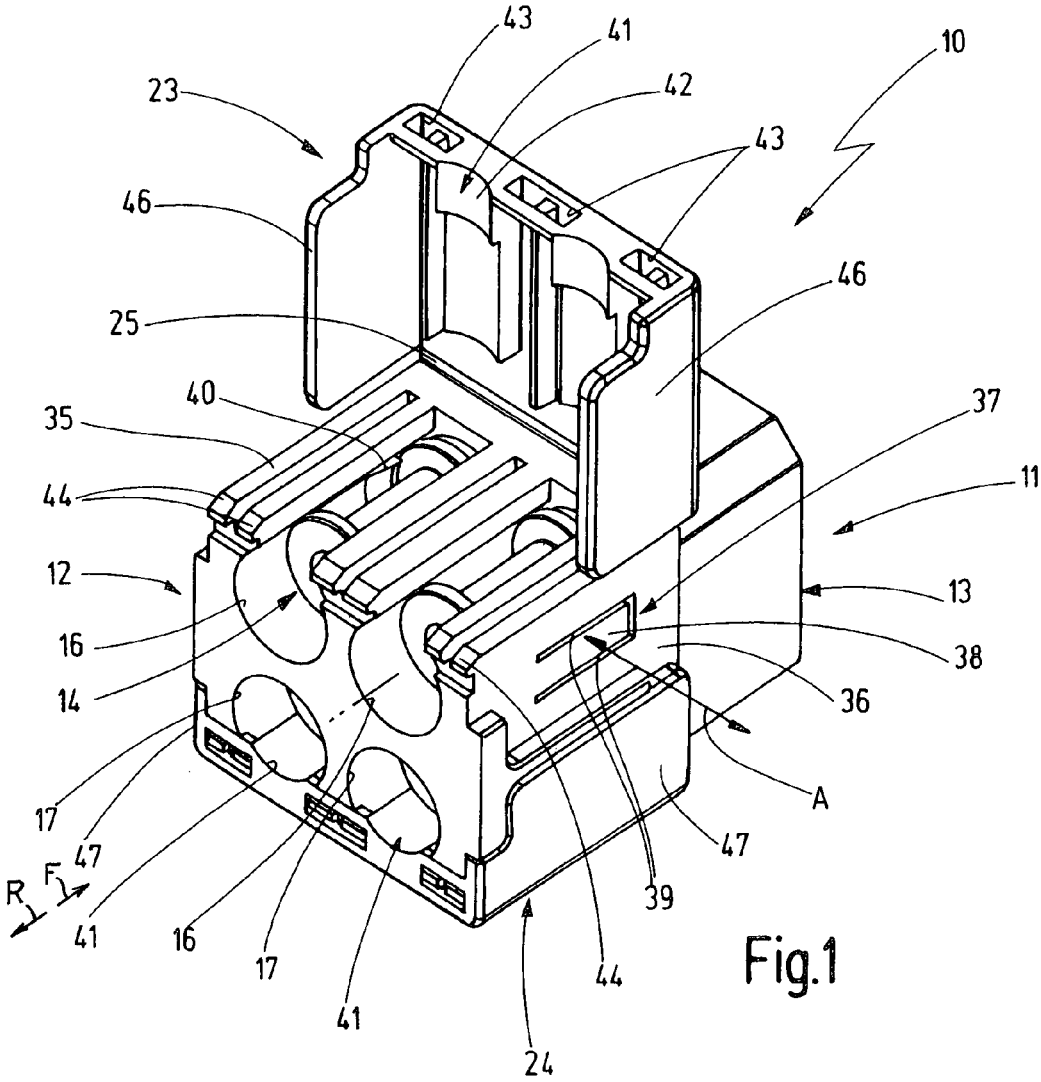
Fig.1
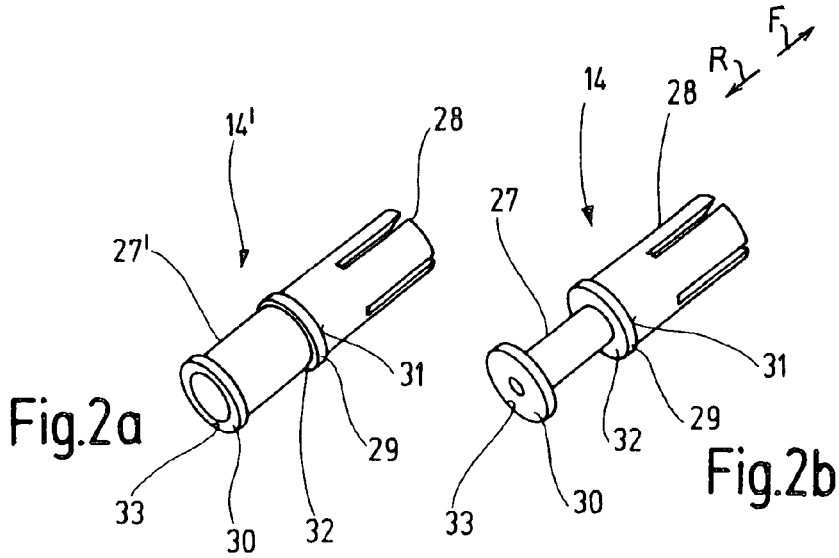
Fig.2a
Fig.2b

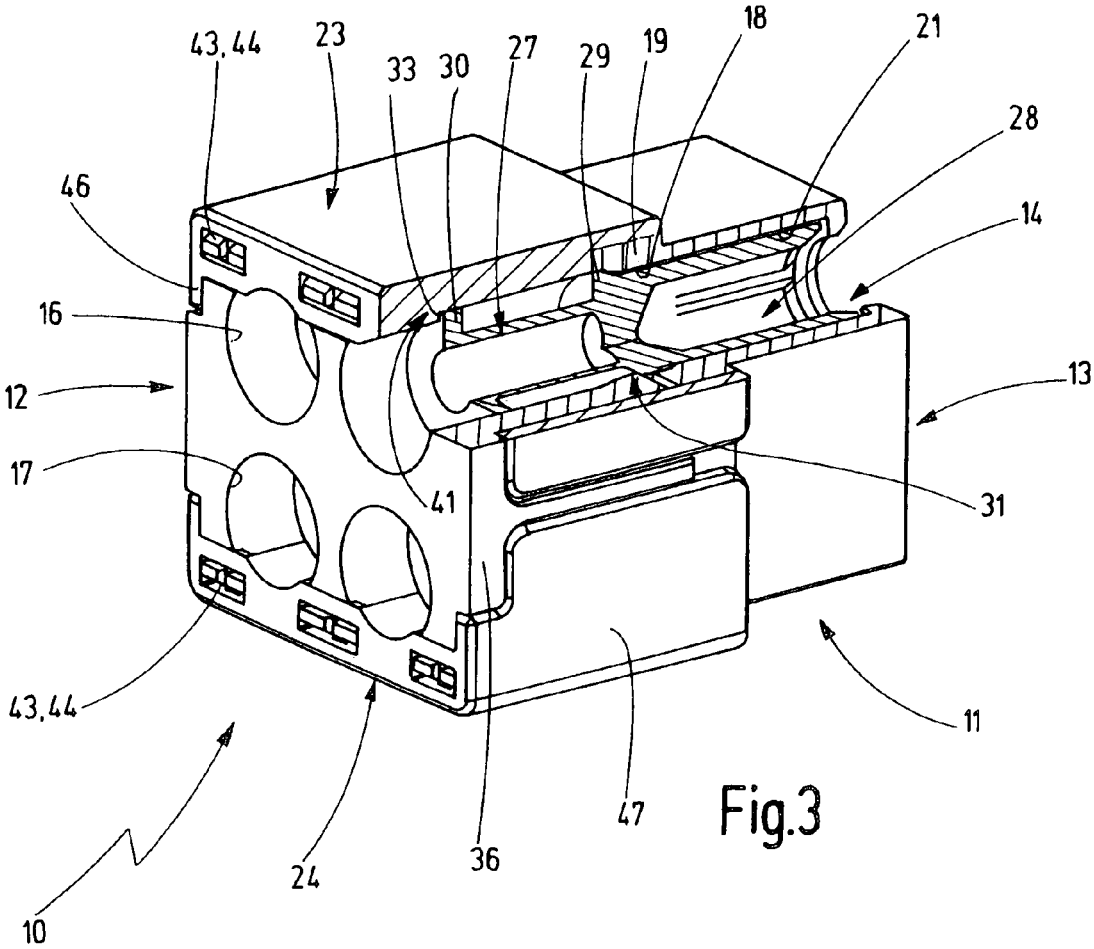
Fig.3
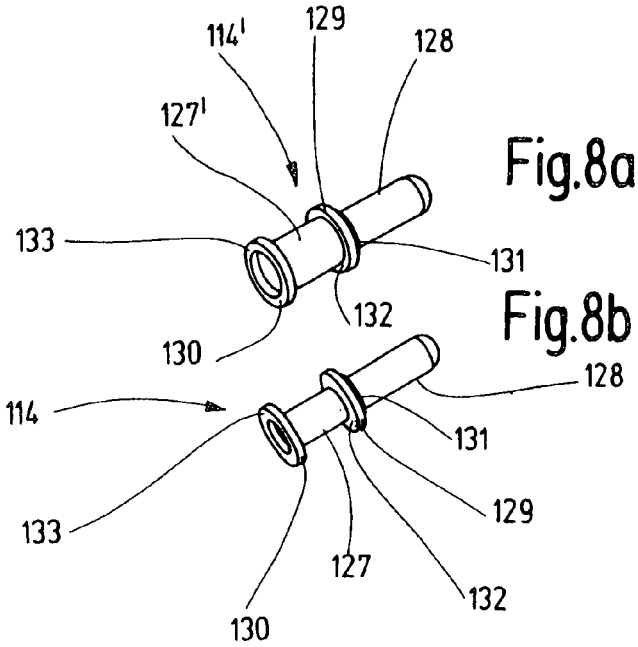
Fig.8a
Fig.8b

PLUG-AND SOCKET CONNECTOR

CROSS-REFERENCE TO RELATED APPLICATION

Applicant claims priority from German patent application no. 10 2006 016 882.8-34 filed Apr. 4, 2006.

BACKGROUND OF THE INVENTION

The present invention relates to a plug-and-socket connector.

In the case of familiar plug-and-socket connectors of this type, the male or female contact is inserted into the housing and is locked into place in one area. Because this male or female contact is inserted into the plastic housing manually, there is no guarantee that each of the male or female contacts will be locked in the correct position or even locked into place at all.

It is therefore the objective of the present invention to create a plug-and-socket connector of the type mentioned above, in which it is undertaken to lock the male or female contacts in two ways, independently of each other, in the plastic housing, thus preventing any failure to lock from going undetected, at the same time making it possible to mold the plastic housing injection molding technology in a relatively simple manner.

In a plug-and-socket connector of the aforementioned type, the features indicated in Claim 1 are provided so as to achieve this objective.

SUMMARY OF THE INVENTION

As a result of the measures indicated in accordance with the invention, it is achieved that the male or female contacts are pre-locked in the desired position during insertion or placement into the plastic housing and, when the cover is closed, then and only then are finally locked and can only be locked if the prelocking is carried out in the prescribed manner. If the subsequent, second locking process cannot take place, this is detected due to the incorrect position of the cover.

The features in accordance with Claim 2 and, if applicable, Claim 3 are provided in the advantageous configuration of the first catch, which likewise leads to a simple and externally visible locking.

An expedient configuration of the male or female contacts with respect to their locking process can be seen from the features of Claim 4 and, if applicable, those of Claim 5. In this way, not only a secure limit stop is achieved for the connector contacts, but also the rear crimping area can have varying exterior diameters in order to accommodate electrical leads of varying thicknesses since only the collar area absorbs the impact of the mating catch.

In an advantageous manner, the second catch is configured on the cover in accordance with the features of Claim 6 and, if applicable, those of Claim 7. In this way, the second catch is situated so as to be rotated and/or it has an axial clearance with respect to the first catch, thus assuring a uniform contact of the cover on the plastic housing.

The features of Claim 8 and, if applicable, those of Claim 9 are provided in accordance with another exemplary embodiment, resulting in additional security with respect to a correct locking of the connector contacts within the plastic housing.

In accordance with features of Claim 10, the cover is preferably hinged on the housing through a film hinge, resulting in a simplification of both the assembly process as well as of the die needed for manufacturing the plastic housing. In this context, it can be expedient to provide the features according to Claim 11.

The cover on the plastic housing is secured through the features in accordance with Claim 12 and/or 13.

On the basis of the features of Claim 14, after final assembly, the first catch located in the wall is prevented from moving to the outside and thus from potentially releasing the connector contacts due to traction during the connecting or separating of two plug-and-socket connectors. The air gap and creep path are also increased as a result.

Advantageous configurations of an arrangement of several rows and/or columns of male or female contacts emerge from the features of Claim 14 and, if applicable, those of Claim 15, or in accordance with the features of Claim 16 and/or, if applicable, one or both of Claims 17 and 18.

Further details of the present invention can be derived from the following description, in which the invention is described and discussed in greater detail on the basis of the exemplary embodiments depicted in the drawing. In the drawing:

DESCRIPTION OF THE DRAWINGS

FIG. 1 in a schematic isometric view of a plug-and-socket connector in accordance with a first embodiment of the present invention, with an open cover.

FIGS. 2*a* and 2*b* are isometric views of two designs of socket contacts that can be used in the plug-and-socket connector of FIG. 1.

FIG. 3 is an exploded isometric view of a plug contact and a plug-and-socket connector of FIG. 1, with a closed cover.

FIGS. 8*a* and 8*b* are isometric views of two designs of socket contacts that can be used in the plug-and-socket connectors of FIGS. 6 and 7.

DESCRIPTION OF THE INVENTION

Figure 4:
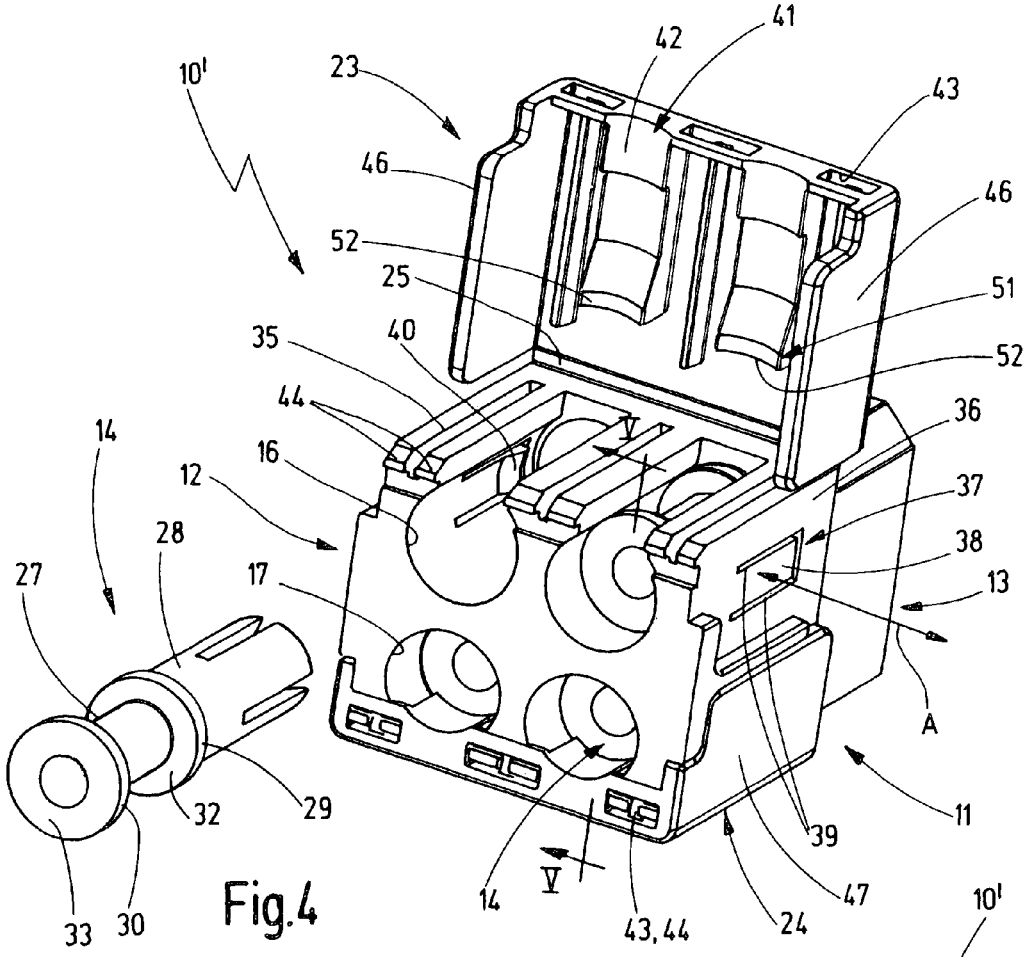
FIG. 4 is an isometric view of a plug-and-socket connector of a second embodiment of the invention.

Electrical plug-and-socket connector 10, 10' or 110 (FIGS. 1, 4, 6) depicted in the drawing in three embodiments can be connected, on the one hand, to electrical leads or wires (not shown) and each can be connected to a mating plug-and-socket connector (not shown) which also is or can be connected to electrical leads. For example, plug-and-socket connectors 10, 10' in accordance with FIGS. 1 to 5 are each provided with a plastic housing 11, 11' having a plug extension 13 and metal socket contacts 14. Also, electrical plug-and-socket connector 110 (FIG. 6) has a plastic housing 111, a socket extension 113, and metal male contacts 114. The corresponding mating electrical plug-and-socket connectors are similarly designed with respect to individual electrical plug-and-socket connectors 10, 10', 110.

According to FIG. 1, electrical plug-and-socket connector 10 has a housing 11 made of plastic (non electrically conductive). The connector has a forward F plug extension 13 and a rear R receiving part 12 for inserting or sliding in socket contacts 14 that are connected to electrical leads. Housing 11 in its rear receiving part 12 has two double receiving boreholes 16 and 17, which are arranged over and next to each other, thus creating an upper row of two adjacent receiving boreholes 16 in accordance with FIG. 1 and a lower row of two adjacent receiving boreholes 17. Receiving boreholes 16 and 17 are identical and are connected to and aligned with corresponding receiving boreholes 21 and 22 (FIG. 5) in socket extension 13 via a through borehole 18 that is visible in FIG. 3 in an intermediate wall 19. Receiving boreholes 16 and 17 are open to upper and lower longitudinal wall 35 of rear receiving part 12 along a circumferential area of less than 180°. This open longitudinal wall 35 of rear receiving part 12 can be covered by an upper or lower cover 23 or 24. For this purpose, cover 23, 24 is hinged at an area between rear receiving part 12 and forward plug extension 13 along a film hinge 25 on plastic housing 11. FIG. 1 shows upper cover 23 in the open position and lower cover 24 in the closed position.

Inserted into rear and forward receiving boreholes 16 and 21 and 17 and 22 are socket contacts 14, which have a rear crimping area 27, a forward socket area 28, and a first collar 30 on the rear free end of crimping area 27. From FIGS. 2*a* and 2*b* it can be seen that crimping area 27, 27', which is accommodated in rear receiving boreholes 16, 17, can have varying exterior diameters and therefore also interior diameters in order to connect electrical leads of varying diameters to socket contact 14 by compressing or crimping rear crimping area 27, 27'. In any case, both first collar 29 as well as second collar 30 each have a greater diameter than socket area 28 or one of crimping areas 27, 27'. First and second collars 29, 30 have first, second, and third contact surfaces 31, 32, 33 for the sake of contacting and locking arrangements that are described below.

In the case of electrical plug-and-socket connector 10 in accordance with FIGS. 1 and 3, first catches 37 for socket contacts 14 are each arranged in sidewalls 36 that are perpendicular with respect to open longitudinal walls 35 of plastic housing 11, whereby each catch 37 is assigned to a socket contact 14 that is arranged in a receiving borehole 16, 17. In other words, first catches 37 are situated one on top of the other on both sidewalls 36. Each first catch 37 is formed by a tongue-like notch 38 in side wall 36, whereby, as a result of two parallel slots 39, it can move to a limited degree in spring-like elastic fashion in the direction of double arrow A. The free, mobile end of tongue-like notch 38 is provided so as to face plug extension 13 of housing 11. Tongue-like notch 38 facing the interior side of receiving borehole 16, 17 has a latch 40, which locks behind a second contact surface 32 of first collar 29 of socket contact 14 when conical, first contact surface 31 of first collar 29 contacts intermediate wall 19, i.e., socket area 28 is located entirely within plug extension 13. The locking is accomplished by first catch 37, provided that socket contact 14, having the electrical lead attached thereto, has been inserted from the rear into receiving borehole 16, 17 up to the aforementioned limit stop. This takes place in the open state of the housing, i.e., when both covers 23 and 24 are open, so that tongue-like notch 38 can move elastically to the outside beyond the surface of side wall 36 during the locking motion.

Both leaf-like covers 23 and 24 have on their rear end a fixed second catch 41 having catch projections 42 that are curved at the surface, that are each assigned to one of socket contacts 14, and that, when cover 23, 24 is closed, penetrate into open receiving boreholes 16 and 17, thus engaging behind second collar 30 along its third contact surface 33. This locking connection can only occur if first locking connection 37, 29 has occurred correctly. Catch projection 42 of second catch 41 therefore engages at socket contact 14 so as to be offset in the circumferential direction by 90° with respect to first catch 37.

Cover 23, 24 also has a locking mechanism that cooperates with rear receiving part 12 of housing 11, said receiving part being formed by front-end recesses 43 on both sides of second catch 41 and by front-end, longitudinal projections 44 in rear receiving part 12, which engage in recesses 43. Cover 23, 24 also has sidewalls 46 and 47, which cover sidewalls 36 when the cover is closed, thus covering first catches 37 and preventing their being deflected to the outside, which also causes an increase in the air gaps and creep paths.

Figure 5:
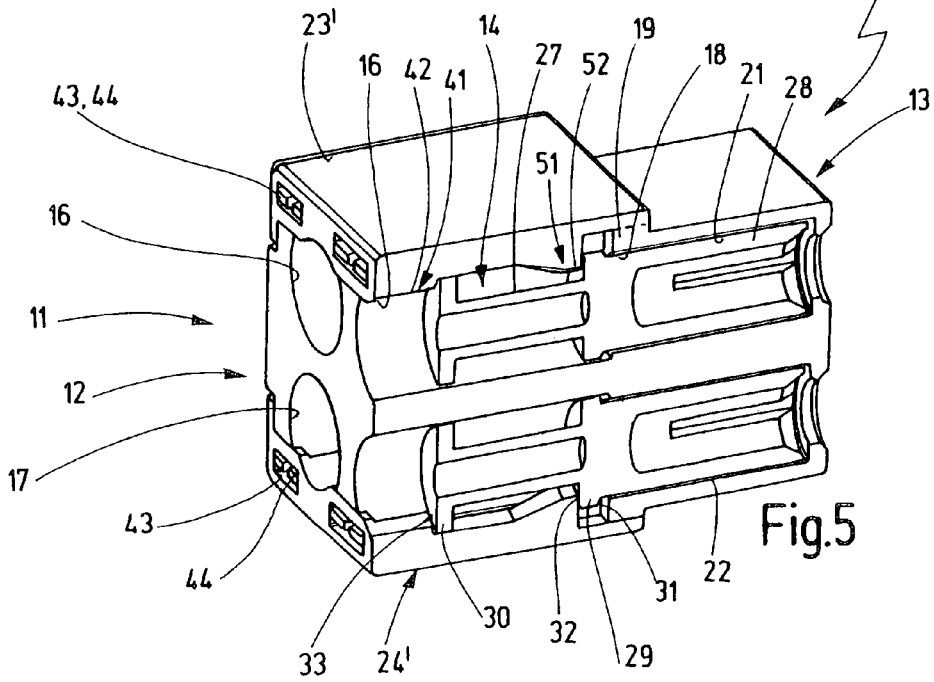
FIG. 5 is an isometric sectional view taken on line V-V of FIG. 4, with the cover closed.

FIGS. 4 and 5 depict an exemplary embodiment in the form of electrical plug-and-socket connector 10', which differs from electrical plug-and-socket connector 10 as indicated in FIGS. 1 and 3 in that cover 23', 24' is provided with a third catch 51 in the form of a concave catch extension 52 that is arranged so as to be fixed in the transverse direction and that, as in the case of catch extension 42 of second catch 41, engages in open receiving borehole 16, 17, when cover 23', 24' is closed, thus coming into contact at first collar 29 behind second contact surface 32. For this purpose, catch extension 52 of third catch 51 is axially set apart from catch extension 42 of second catch 41. The arrangement of both catches 41 and 51, when covers 23', 24' are dosed, can be seen from FIG. 5 with respect to socket contacts 14. Furthermore, the position of collar 29 of socket contact 14 is visible on intermediate wall 19' as is the position of socket area 28 within receiving boreholes 21 and 22 in plug extension 13 of plug-and-socket connector 10'.

Figure 6:
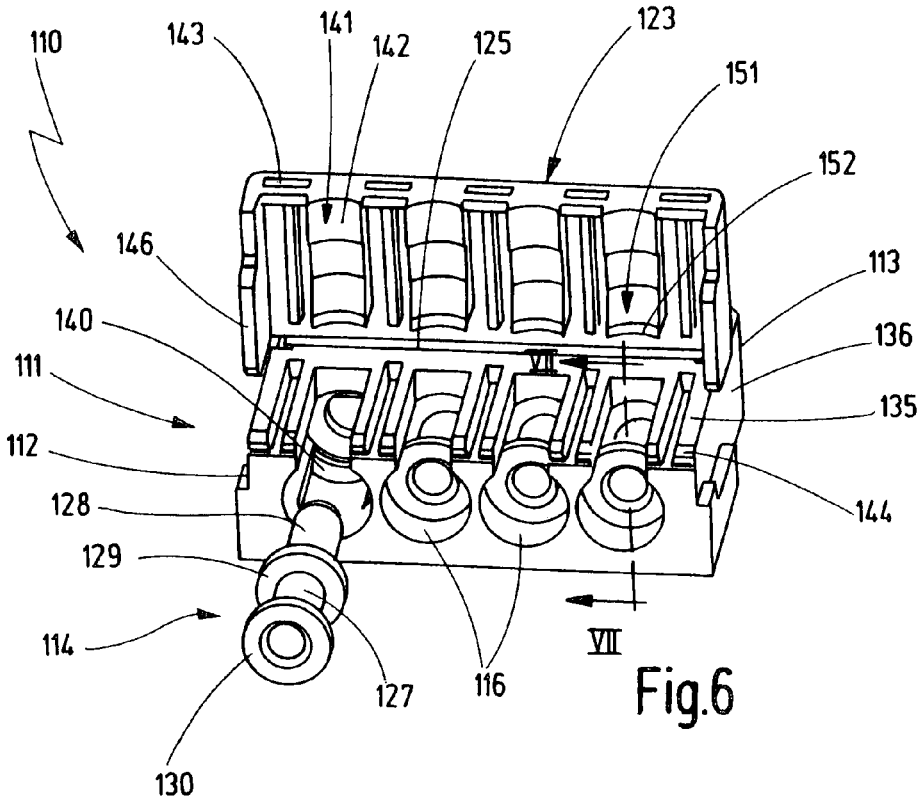
FIG. 6 is an isometric and exploded view of a plug-and-socket connector of a third embodiment of the invention, with the cover open.
Figure 7:
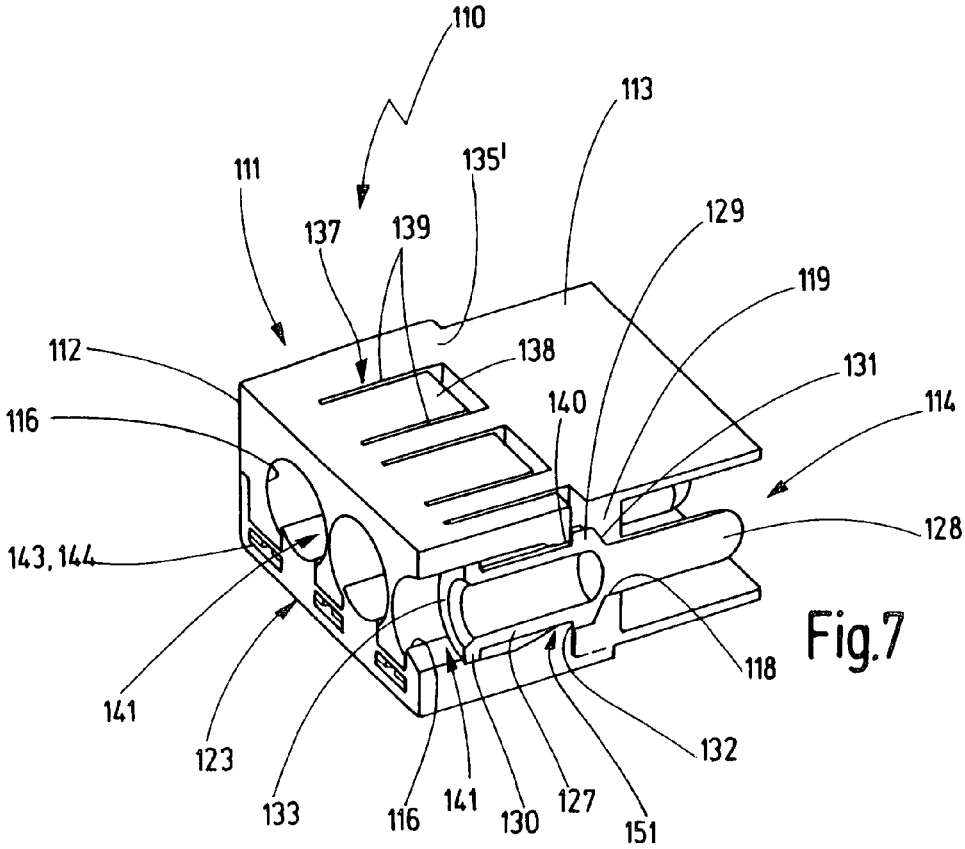
FIG. 7 is an isometric sectional view of the connector of FIG. 6 taken on line VII-VII of FIG. 6, with a closed cover and with the connector rotated 180° from the position of FIG. 6.

FIGS. 6 and 7 depict electrical plug-and-socket connector 110, in which plastic housing 111 is configured in planar fashion such that only one row of, in this case, four adjoining receiving boreholes 116 is provided for plug contacts 114. In this exemplary embodiment, a single cover 123 is hinged in leaf-like fashion at an open upper longitudinal wall 135 of rear receiving part 112 of housing 111 by means of a film hinge 125.

Cover 123 also has second catch 141 and third catch 151, whereby cover 123 can also have only one of catches 141 or 151. Catches 141 and 151 act on plug contacts 114 accordingly, namely at their first collar 129 or second collar 130. In the locked condition, plug contacts 114 are situated with their conical, first contact surface 131 on intermediate wall 119 between rear receiving part 112 and socket extension 113, in whose hollow space 126 plug areas 128 of plug contacts 114 are situated.

On longitudinal wall 135' that faces away from cover 123 and that is on the bottom here, first catch 137 is provided so as to be assigned to each receiving borehole 116. In its configuration, this first catch 137 corresponds to first catch 37, 37' of the aforementioned exemplary embodiments; it therefore has a notch 138 in lower longitudinal wall 135', which is bordered by parallel slots 139, whose spring-action locking nib 140, positioned towards the inside, engages behind second contact surface 132 of first collar 129 of plug contact 114.

In accordance with FIGS. 8*a* and 8*b*, crimping areas 127, 127' of plug contacts 114, 114', which are accommodated in rear receiving boreholes 116, have varying exterior and therefore interior diameters, in order to connect electrical leads of varying diameters with plug contact 114, 114' by compressing or crimping rear crimping area 127, 127'. In any case, both first collar 129 as well as second collar 130 are each larger in diameter than plug area 128 or crimping area 127, 127'.

In this configuration of a planar plug-and-socket connector 110, it is possible to place two plug-and-socket connectors 110 of this type with their lower longitudinal walls 135' opposite each other or to stack them up, so as to prevent an unintended motion of spring-action tongue-like notch 138 when a plug connection is made, and in particular so as to thus create a multi-row plug-and-socket connector.

In the exemplary embodiment shown in FIG. 6, cover 123 is likewise provided with sidewalls 146, 147, whose free front ends contact the corresponding surface areas of receiving part 112. In addition, corresponding cover locking mechanisms 143, 144 are provided that face away from film hinge 125.

Of course, in all exemplary embodiments, the mating plug-and socket connectors that fit in each case are configured accordingly, whereby the only difference in the configuration lies in the plug contacts in FIGS. 1 to 5 or in the socket contacts in FIGS. 6 to 8.

What is claimed is:

1. A plug-and-socket connector (10; 110) having a housing (11; 111) made of plastic, in which electrical contacts (14; 114) with collars (29, 129; 30, 130) are accommodated in boreholes (16, 17; 116) lying adjacent to each other, the housing having a forward end forming an extension (13) and having a rear end forming a rear extension (12), each extension configured to receive contacts, wherein:

said housing rear end has a first catch (37; 137) that protrudes into each borehole (16, 17; 116), said first catch lying on a fixed wall (36; 135) of the rear housing end and engaging a rear of a first collar (29; 129) of the contact (14; 114);

said housing has a cover (23, 24; 123) that can be opened and closed, said cover having a second catch (41, 51; 141, 151) that engages a rear of a second collar (30; 130) of the contact wherein the first catch is provided in an area of a closed wall that is on the side that faces away from the cover.

2. The plug-and-socket connector as recited in claim 1, wherein the first catch (37; 137) is formed in the appropriate wall area by an elastically spring-like notch (38; 138) in a wall of the housing.

3. The plug-and-socket connector as recited in claim 1, wherein the contact has a rear crimping area (27) of smaller diameter than either of said collars, and the contact has a female, or socket, area (28; 128) at its front end, and the first collar (29; 129) of said contact (14; 114) lies between said contact rear crimping area (27; 127) and its female area (28; 128).

4. The plug-and-socket connector as recited in claim 3, wherein the first collar (29; 129) has a contact surface (31; 131) that is opposite the contact surface (32, 132), that cooperates with the first catch (37; 137), and that makes contact at a wall (19; 119) between the rear and the forward housing end (12, 13; 112, 113).

5. The plug-and-socket connector as recited in claim 1, wherein the second catch (41, 51; 141, 151) is configured on the cover (23, 24; 123) as a fixed locking projection (42, 52; 142, 152) that penetrates into the radially open borehole (16, 17; 116).

6. The plug-and-socket connector as recited in claim 5, wherein the second catch (41; 141) is arranged on the end area of the rear housing that faces away from the forward housing end and grasps the second collar (30; 130) that forms the free end of the male or female contact (14; 114) from behind.

7. The plug-and-socket connector as recited in claim 1, wherein the cover (23, 24; 123) is provided with a third catch (51, 41; 151, 141), which engages behind the first or second collar (29, 30; 129, 130) of the male or female contact (14; 114).

8. The plug-and-socket connector as recited in claim 7, wherein the third catch (51, 41; 151, 141) is configured on the cover (23, 24; 123) as a fixed locking projection (52, 42; 152, 142) that penetrates into the radially open borehole.

9. The plug-and-socket connector as recited in claim 1, wherein the cover (23, 24; 123) is configured as a leaf that is hinged on the housing (11; 111) by a film hinge (25; 125).

10. The plug-and-socket connector as recited in claim 9, wherein the cover (23, 24; 123) is hinged in the area between the rear housing end (12; 112) and the forward housing end (13; 113).

11. The plug-and-socket connector as recited in claim 9, wherein the cover (23, 24; 123) can be locked to the rear housing end (12; 112) at the free end of the cover facing away from the film hinge (25; 125).

12. The plug-and-socket connector as recited in claim 11, wherein the cover (23, 24; 123) has front-end recesses, and the rear housing end (12; 112) has front-end locking nibs (44; 144) on both sides of the second catch (41, 51; 141, 151) or of the receiving boreholes (16, 17; 116).

13. The plug-and-socket connector as recited in claim 1, wherein the cover (23, 24; 123) has sidewalls (46, 47; 146, 147), which cover the first catch (37; 137) in the wall (36; 135) of the rear housing end (12; 112).

14. The plug-and-socket connector as recited in claim 1, wherein two or more rows on top of each other, each having two adjoining receiving boreholes (16, 17), are provided with male or female contacts (14).

15. The plug-and-socket connector as recited in claim 14, wherein two covers (23, 24), configured as leaves, are arranged on upper and lower housing walls (35, 35') situated opposite each other, and the first catches (37) are provided on both side walls (36) and are assigned to each receiving borehole (16, 17).

16. The plug-and-socket connector as recited in claim 1, wherein a single row having a plurality of receiving boreholes (116) that are arranged next to each other are provided with male or female contacts (114).

17. The plug-and-socket connector as recited in claim 16, wherein a cover (123) that is configured as a leaf is provided on a longitudinal wall (135), and the first catches (137) of each receiving borehole (116) are provided on the opposite longitudinal wall (135').

18. The plug-and-socket connector as recited in claim 16, wherein two plug-and-socket connectors (110) having longitudinal walls (135') that have the first catches (137) can advantageously be stacked on top of each other.

* * * * *